US007226126B1

(12) United States Patent
Spanovich

(10) Patent No.: US 7,226,126 B1
(45) Date of Patent: Jun. 5, 2007

(54) ACCESSORY HOLDER FOR A CHAIR

(76) Inventor: Joseph P. Spanovich, 113 Douglas La., Bristol, TN (US) 37620

( * ) Notice: Subject to any disclaimer, the term of this patent is extended or adjusted under 35 U.S.C. 154(b) by 59 days.

(21) Appl. No.: 11/500,990

(22) Filed: Aug. 9, 2006

(51) Int. Cl.
*E09H 15/48* (2006.01)

(52) U.S. Cl. ..... 297/184.16; 297/188.2; 135/96; 248/539; 248/540

(58) Field of Classification Search ..... 297/184.16, 297/188.2, 188.06; 135/16, 90, 96, 98, 120.3; 248/511, 518, 534, 539, 540, 230.7
See application file for complete search history.

(56) References Cited

U.S. PATENT DOCUMENTS

| | | | | |
|---|---|---|---|---|
| 2,743,146 A | | 4/1956 | Wheeler | |
| 2,756,760 A | | 7/1956 | La Grotteria | |
| 4,318,567 A | | 3/1982 | Guthier | |
| 4,865,381 A | * | 9/1989 | Van Rogue | 297/184.15 |
| 4,871,141 A | | 10/1989 | Chen | |
| 5,000,210 A | * | 3/1991 | Worthington, Jr. | 248/231.81 |
| 5,022,420 A | * | 6/1991 | Brim | 135/88.01 |
| 5,203,363 A | * | 4/1993 | Kidwell et al. | 297/184.15 |
| 5,269,157 A | | 12/1993 | Ciminelli et al. | |
| 5,797,650 A | * | 8/1998 | Gonzalez et al. | 297/184.1 |
| 5,836,327 A | | 11/1998 | Davis | |
| 5,873,624 A | | 2/1999 | Simpson | |
| 6,439,659 B1 | | 8/2002 | Neubauer, Jr. | |
| 6,789,557 B1 | * | 9/2004 | Wahl, Jr. | 135/154 |

* cited by examiner

*Primary Examiner*—Peter R. Brown
(74) *Attorney, Agent, or Firm*—Shlesinger, Arkwright & Garvey LLP

(57) ABSTRACT

An accessory holder for a chair comprising of a support arm having a first end and second end, the first end is adapted for connection to an accessory such as an umbrella or tray, at least one locking member extending from the support arm second end, at least one locking member comprising a pair of cooperating sleeve members adapted to be slidingly engaged in a concentric manner, one of the cooperating sleeves is adapted to be disposed around a leg of a chair whereby when the other cooperating sleeve members is slidingly engaged in a concentric manner with one of the pair of cooperating sleeves, the support arm is secured to the chair.

13 Claims, 3 Drawing Sheets

FIG. 6
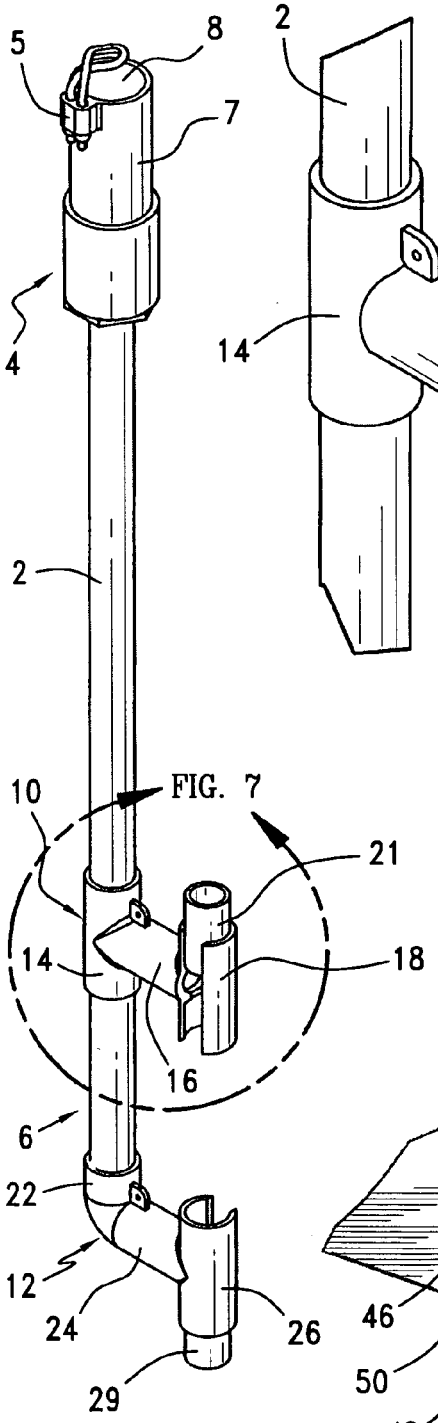
FIG. 7
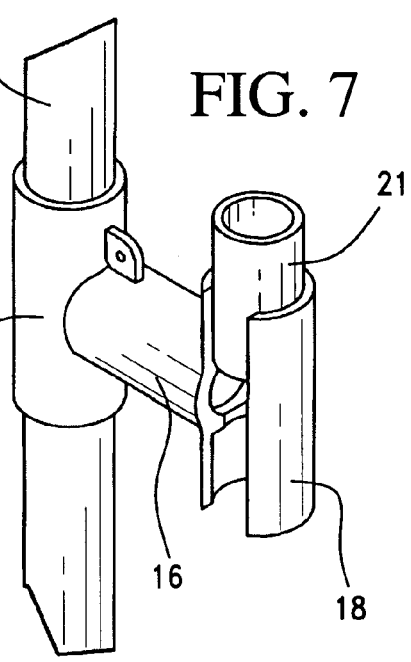
FIG. 8
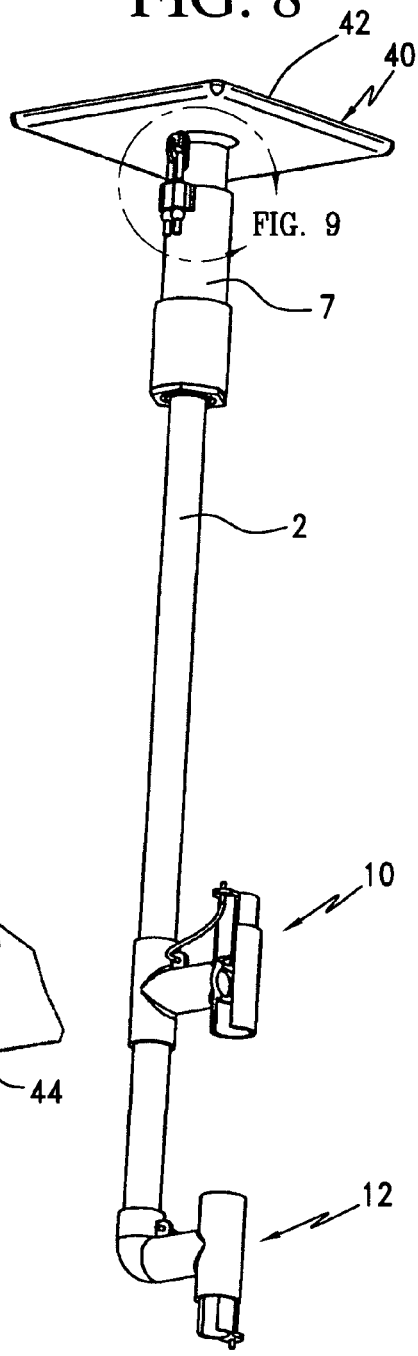
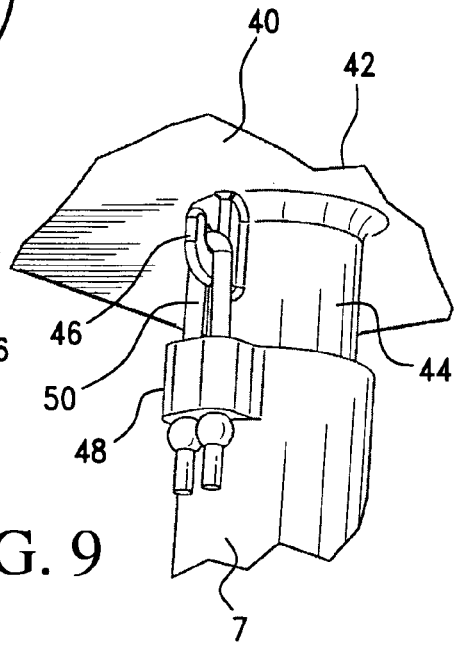
FIG. 9

ACCESSORY HOLDER FOR A CHAIR

FIELD OF THE INVENTION

The present invention relates to devices for securing an umbrella or other accessory to a chair.

BACKGROUND OF THE INVENTION

It is known to attach an umbrella to a chair to provide shade and protection. It is similarly known to secure a tray or cup holder to a chair. These attachment devices eliminate the need for having to hold an umbrella or tray while seated and thereby free up the use of one's hands.

Prior art attachment devices are usually secured to the upper portion of the chair with a single clamp having a screw or wing nut that tightens the clamp to the frame of the chair.

The prior art devices are not satisfactory if a large umbrella is secured to the chair because such umbrellas will render the attachment device unstable due to cantilever forces caused by wind acting on the umbrella and the weight of the umbrella. Further, prior art clamp members for chairs are known to have a complicated construction that makes it difficult to attach the umbrella in an efficient manner. The screws associated with such clamps are subjected prematurely to wear and failure. In addition, clamps employing screws are known to damage the chair frame because of the high grip forces required for attachment. Prior art accessory holders are typically constructed from metal materials because screws are used in the clamps; however, such devices do not provide a secure anchor for the umbrella and are subjected to rusting and eventual failure.

None of the prior art devices are adapted to receive a golf umbrella or similarly large and heavy umbrella that is unwieldy and therefore difficult to secure to a chair in a fixed manner.

Finally, none of the prior art devices are known to secure an umbrella to the chair whereby the attachment can be made to the leg portion of the chair. In the case of folding chairs, all of the prior art devices must be removed from the chair prior to folding and cannot remain secured to the chair when it is in a folded position.

OBJECTS AND SUMMARY OF THE INVENTION

The present invention is directed to an accessory support device for a chair comprising a vertical support arm having a first end and a second end, the first end is adapted to be connected to an umbrella or other device to be supported and the second end is adapted to be secured to a vertically extending leg of a chair by at least one locking member comprising a pair of cooperating sleeves adapted to slidingly engage together in a concentric manner, at least one of said cooperating sleeves is disposed around the leg of a chair whereby when said cooperating locking sleeves are caused to be slidingly engaged, the support device is locked to the leg of the chair.

It is an object of the invention to provide an accessory holder for a chair that is adapted to support a conventional golf umbrella by securing the device to the leg portion of the chair at two separate attachment points and thereby increase stability of the accessory support device when an umbrella is attached.

It is a further object of the invention to provide an accessory holder adapted for use with a folding type chair and which need not be removed from the chair when the chair is folded.

It is another object of the invention to provide an attachment device that may be quickly secured to the chair with a minimum of effort and without additional tools of which comprises few moving parts thereby reducing construction costs and improving reliability.

Yet another object is to provide an attachment device that can secure a conventional umbrella, golf type umbrella, or tray member to the chair.

A further object of the present invention is to provide an attachment member for an umbrella that is adapted to secure the device to any of the leg members of the chair and thereby provide maximum adjustment of the umbrella positioning.

It is yet another object of the present invention to provide a locking mechanism for securing the attachment device to the chair that can be actuated with a minimum of effort and does not loosen or require re-tightening over time as is the case with prior art clamps.

A further object of the present invention is to provide an accessory holder that may be secured to the leg of a chair and in a manner that permits the accessory holder to be rotated about the longitudinal axis of the chair leg so an umbrella in the holder may be repositioned without the need to disassemble the holder from the chair.

Another object is to provide a simplified clamping structure that spreads the clamping load across the length of the leg of the chair thereby improving clamping strength and reducing failure.

Other objects and advantages will be apparent from the following description and claims.

BRIEF DESCRIPTION OF THE DRAWINGS

FIG. 6 is a perspective view of another embodiment of the accessory holder according to the present invention;

FIG. 7 is an enlarged view of the upper attachment arm of the accessory holder shown in FIG. 6;

FIG. 8 is a perspective view of the accessory holder of the present invention with a tray member; and FIG. 9 is an enlarged and broken away perspective view of the upper portion of the accessory holder shown in FIG. 8.

DETAILED DESCRIPTION OF THE PREFERRED EMBODIMENTS

Figure 1:
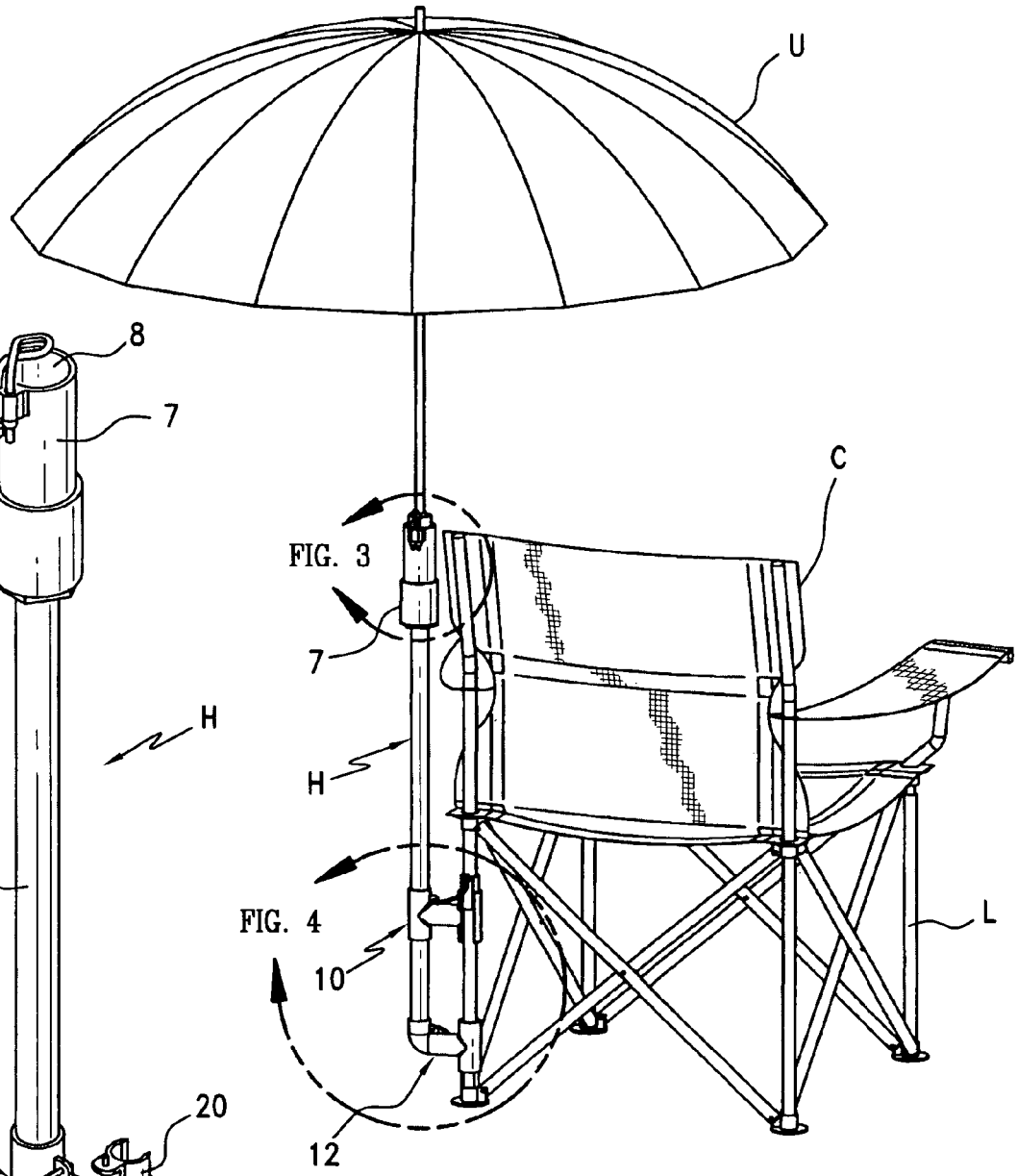
FIG. 1 is a perspective view of the accessory holder of the present invention secured to a folding type chair and with an umbrella positioned in the holder.

FIG. 1 illustrates a first embodiment of the present invention and shows the accessory holder H attached to a leg L of folding chair C with an umbrella U secured within the holder H. It is of course within the scope of the present invention to secure the accessory holder to a non-folding chair with little to no modification.

Figure 2:
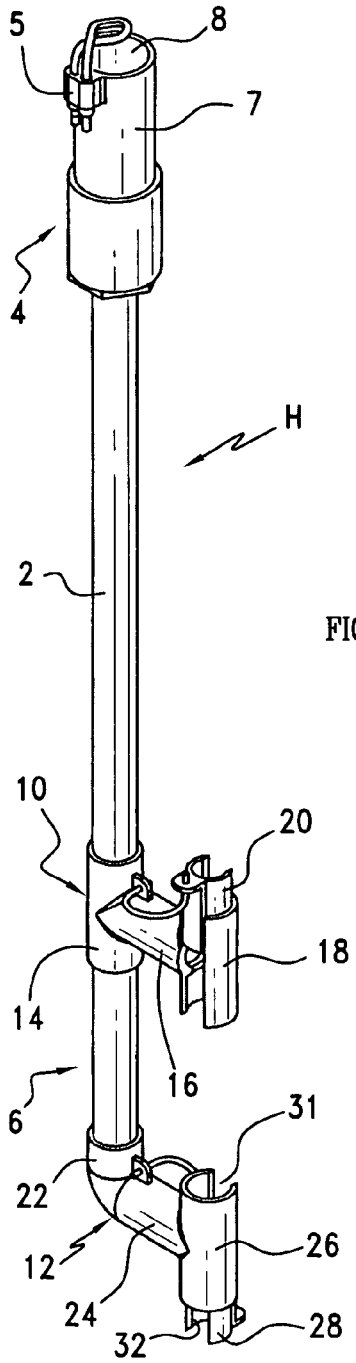
FIG. 2 is a perspective view of the accessory holder of the present invention.
Figure 3:
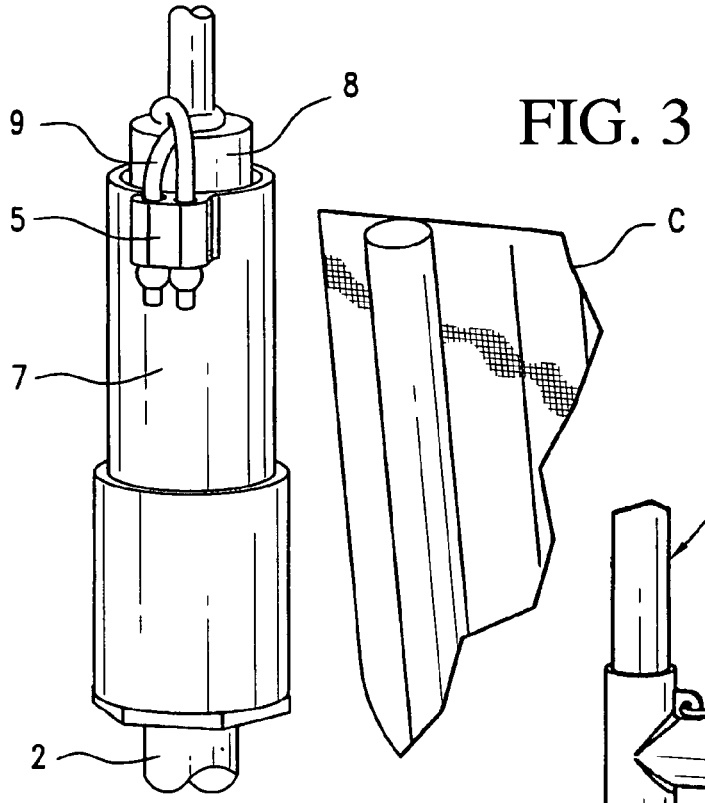
FIG. 3 is an enlarged and broken away perspective view of the upper portion of the accessory holder including a portion of the chair as shown in FIG. 1.

As best shown in FIG. 2, the accessory holder H generally comprises a support member 2 having a first or upper end 4 and an opposite second or lower end 6. FIG. 3 shows the upper end 4 of support member 2 to be provided with a receptacle or socket 7 having an opening adapted to receive a golf umbrella handle 8. The socket 7 for receiving the handle 8 includes a cord attachment lug 5 with cooperating elastic shock cord 9 for securing the handle 8 within the socket 7. As is apparent, other arrangements for securing the handle within a socket or to the end of the support member 2 are within the scope of the present invention.

Figure 4:
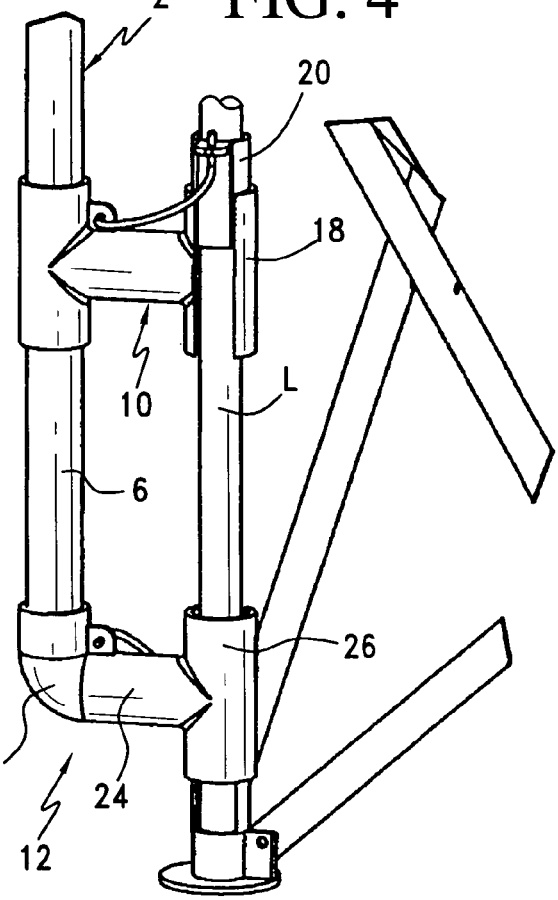
FIG. 4 is an enlarged and broken away perspective view of the lower portion of the accessory holder and a portion of the chair shown in FIG. 1.

FIG. 4 illustrates the lower end 6 of support member 2 is provided with a pair of attachment arms 10 and 12, generally extending transverse to the support member 2, for securing the accessory holder H to the leg L of a chair C.

Figure 5:
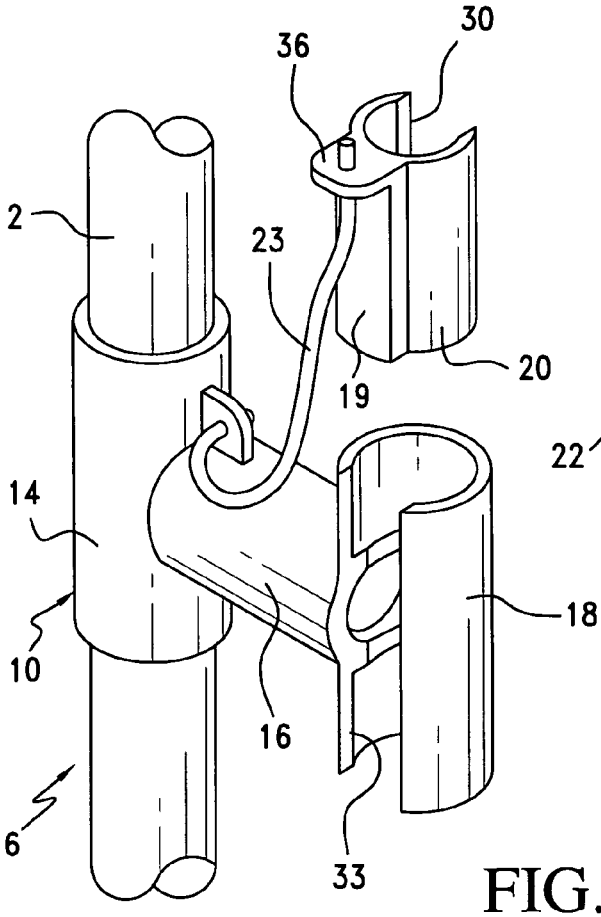
FIG. 5 is an enlarged and broken away perspective view of the upper attachment arm of the accessory holder and showing the split retainer sleeve in an unlocked position.

Turning to FIG. 5, the upper attachment arm 10 is shown in greater detail and can be seen to comprise a tubular sleeve 14 fixed to the lower end 6 of support member 2, a connecting member 16 extending laterally from sleeve 14, a split sleeve 18 secured to the opposite end of connecting member 16 and a locking sleeve 20 which cooperates with split sleeve 18. The locking sleeve 20 includes an offset filling 19 and is preferably provided with a leash 23 for retaining the locking sleeve 20 adjacent to the associated split sleeve 18. Split sleeve 18 includes a longitudinal opening or split 33 extending the length of the sleeve and having a width sufficient so as to allow the sleeve 18 to receive the leg L of a chair C and as best shown in FIG. 4.

In a similar manner and as best shown in FIGS. 2 and 4, the lower attachment arm 12 is provided with an elbow or sleeve 22 fixed to the lower end 6 of support member 2, a connecting member 24 extending laterally from sleeve 22, a split sleeve 26 secured to an opposite end of connecting member 24 and a locking sleeve 28 adapted to cooperate with split sleeve 26. Locking sleeve 28 is shown to be the same as locking sleeve 20 described above and is also provided with an offset filling and tab (not shown). Split sleeve 26 includes a longitudinal opening or split 31 that extends the length of the sleeve and which has a width sufficient to allow the sleeve 26 to receive the leg of a chair and as best shown in FIG. 4.

Each of the locking sleeves 20 and 28 is provided with a longitudinal opening or split 30 and 32 extending the length of the sleeve and sufficiently wide to receive the leg of a chair to be attached. The exterior diameter of locking sleeves 20 and 28 is less than the interior diameter of each of sleeves 18 and 26 and locking sleeves 20 and 28 are adapted to be slidably received within the interior of sleeves 18 and 26 to secure the accessory holder H to the chair leg L.

This is best shown in FIG. 4 which illustrates the locking sleeve 20 of upper attachment arm 10 in sliding engagement with sleeve 18 to provide a connection between the upper attachment arm 10 and leg L of the chair C. The concentric press fit engagement of sleeve 18 with locking sleeve 20 secures the sleeve 18 to the leg L of a chair C. A similar connection is provided with the lower attachment arm 12. The offset filling on each locking sleeve prevents the locking sleeve from rotating relative to the sleeve to which it is locked. An extension or tab member 36 is provided on the locking sleeve 20 and functions as a handle for sliding the locking sleeve into and out of engagement with the associated attachment arm. During engagement, the position of the accessory holder H relative to the chair leg may be shifted without the need for disengagement of the device because the locking sleeve 20, even when press fit into engagement with the associated sleeve 18, may be rotated relative to the chair leg around which it is disposed. As is apparent, the two attachment arms 10 and 12 for connecting the device to the chair leg cooperate to provide a secure connection of the umbrella to the chair. Further, when used in connection with a folding type chair as shown in FIG. 1, the device need not be removed from the chair during folding because the device H is secured to the chair in a position that is parallel to the chair leg and the attachment points do not interfere with or otherwise impede folding of the chair. This is advantageous since the accessory device H may be stowed with the folded chair while attached to the chair.

In a preferred embodiment, the accessory holder H is constructed from PVC materials, polypropylene, nylon or other relatively rigid material having sufficient flexibility so that the concentric locking sleeve system may operate in the manner described above. It is within the scope of the present invention to vary the slit opening or thickness of the walls of the device in order to adapt it to a chair having a different leg diameter.

Turning to FIGS. 6 and 7, another embodiment of the present invention is shown where the respective locking sleeves 21 and 29 are not provided with a longitudinal opening or split. In this embodiment, the chair (not shown) is either manufactured to provide locking sleeves 21 and 29 preassembled around a chair leg or legs or the chair is fitted with the locking sleeves 21 and 29 by disassembling the chair. This embodiment eliminates the need for a leash as set forth in the earlier described embodiment but operates in essentially the same manner. The locking sleeves 21 and 29 are concentrically aligned with the cooperating sleeves 18 and 26 and then press fit into locking engagement with the leg of the chair.

FIGS. 8 and 9 show a further embodiment of the present invention wherein a tray member 40 is received within socket 7. The tray member 40 includes a top portion 42 and handle portion 44 which is adapted to be received within the socket 7. The handle portion includes a hook member 46. A lug member 48 including shock cord 50 provided on the end of the accessory holder is adapted to loop around the hook member 46 and secure the tray member in the manner as best shown in FIG. 9.

While this invention has been described as having a preferred design, it is understood that it is capable of further modifications, and uses and adaptations of the invention following in general the principle of the invention and including such departures from the present disclosure as come within the known or customary practice in the art to which the invention pertains, and as may be applied to the central features described above and falling within the scope of the invention or limits of the attached claims.

I claim:

1. An accessory holder for a chair comprising:

a) a support arm, said support arm having a first end and a second end, said support arm first end is adapted for connection to an accessory; and b) at least one locking member, said at least one locking member extends from said support arm second end, said at least one locking member comprising a pair of cooperating sleeve members adapted to be slidingly engaged in a concentric manner, at least one of said pair of cooperating sleeves is adapted to be disposed around a leg of a chair whereby when said other of said pair of cooperating sleeve members is caused to be slidingly engaged in a concentric manner with said at least one of said pair of cooperating sleeves, said support arm is caused to be secured to the chair.

2. An accessory holder as in claim 1 and further including a second locking member, said second locking member extends from said support arm second end and comprises a second pair of cooperating sleeve members adapted to be slidingly engaged in a concentric manner, at least one of said second locking member second pair of cooperating sleeves is adapted to be disposed around a leg of a chair whereby when said other of said second locking member pair of cooperating sleeve members is caused to be slidingly engaged in a concentric manner with said at least one of said second locking member pair of cooperating sleeves, said support arm is caused to be secured to the chair.

3. An accessory holder as in claim 2 and wherein said at least one locking member and said second locking member are adjacent to each other.

4. An accessory holder as in claim 1 and wherein said support arm first end includes a socket member adapted to receive the handle of an umbrella.

5. An accessory holder as in claim 1 and wherein said support arm first end includes a socket member adapted to support a tray member.

6. An accessory holder as in claim 1 and wherein at least one of said cooperating sleeve members of said at least one locking member includes a slit extending along the length thereof.

7. An accessory holder as in claim 6 and wherein the other of said cooperating sleeve members of said at least one locking member is provided with an abutment member configured to be received within said slit.

8. An accessory holder as in claim 1 and wherein said at least one locking member pair of cooperating sleeve members extend parallel to said support arm.

9. An accessory holder as in claim 1 and wherein said at least one locking member pair of cooperating sleeve members are each provided with a slit extending along the length thereof.

10. An accessory holder as in claim 4 and further including a cord member for securing an umbrella handle to said socket.

11. An accessory holder as in claim 1 and wherein said cooperating sleeve members are press fit into engagement.

12. An accessory holder as in claim 11 and wherein said cooperating sleeve members are constructed from a flexible material.

13. An accessory holder as in claim 12 and wherein said material is selected from the group of non-metallic materials consisting of PVC, polypropylene and nylon.

* * * * *